United States Patent [19]

Witkoski et al.

[11] Patent Number: 4,637,237

[45] Date of Patent: Jan. 20, 1987

[54] DOOR LOCKING SYSTEM

[75] Inventors: Edward J. Witkoski, Burlington; Edgar G. Lizotte, Winsted, both of Conn.

[73] Assignee: Simplex Security Systems, Inc., Collinsville, Conn.

[21] Appl. No.: 780,942

[22] Filed: Sep. 27, 1985

[51] Int. Cl.[4] ..... E05B 37/00

[52] U.S. Cl. ..... 70/285; 70/214; 70/129; 70/156

[58] Field of Search ..... 70/285, 129, 134, 288, 70/151 R, 156, 314, 315, 214, 220, 284

[56] References Cited

U.S. PATENT DOCUMENTS

| | | | |
|---|---|---|---|
| 744,858 | 11/1903 | Durnbaugh | 70/285 |
| 1,113,193 | 10/1914 | Carroll | 70/284 |
| 1,309,438 | 7/1919 | Keefer | 70/129 |
| 1,542,358 | 6/1925 | Bellamore | 70/285 |
| 2,109,264 | 2/1938 | Elbaum | 70/220 |
| 2,769,652 | 11/1956 | Maurits et al. | 70/151 R |
| 3,073,143 | 1/1963 | Eads | 70/151 R |
| 3,115,765 | 12/1963 | Fengler | 70/315 |
| 3,353,383 | 11/1967 | Fish | 70/151 R |
| 3,529,454 | 9/1970 | Fish | 70/314 |
| 3,747,377 | 7/1973 | Van Deudekom | 70/314 |
| 3,828,592 | 8/1974 | Horgan, Jr. | 70/134 |
| 3,981,164 | 9/1976 | Balducci | 70/214 |
| 4,027,508 | 6/1977 | McGourty | 70/214 |
| 4,459,835 | 7/1984 | Hurskainen | 70/134 |

FOREIGN PATENT DOCUMENTS

| | | | |
|---|---|---|---|
| 2902012 | 7/1980 | Fed. Rep. of Germany | 70/134 |
| 2458653 | 2/1981 | France | 70/134 |

*Primary Examiner*—Thomas J. Holko
*Assistant Examiner*—Suzanne L. Dino
*Attorney, Agent, or Firm*—Ira Milton Jones

[57] ABSTRACT

A combination lock system on a narrow stile door having selective operation through a drive mechanism including a slide for retraction of the latch bolt operated by the combination lock and a manual control or key operation of the latch bolt. The key operation provides an override of the combination lock operation.

20 Claims, 19 Drawing Figures

6
7
20
24
15
55
53
40
21
47
56
16
54
23
55
17
19

6
7
20
24
53
40
56
41
16
15
21
47
17
23
55
19

DOOR LOCKING SYSTEM

This invention relates to a door locking means and, more particularly, to a door locking system having selective and alternative operation of the door lock through a combination locking means and/or a key operated locking means. The key operated locking means also provides an override for the combination locking means. A control is also provided for changing of the combination locking code.

Door locking means are required for restricted areas where equipment of a confidential nature is kept. A means of access, however, is necessary for personnel who are authorized to enter. To avoid the necessity of wide distribution of keys to the employees, a locking system using permutation or combination locks may be used for those who have knowledge of the code or the combination. For management personnel, however, a key may be provided to override the combination lock. There is no need for knowledge of the code if the lock is key operated.

Related prior art includes the Eads U.S. Pat. No. 3,073,143 which shows a lock hold-back latch with a latch bolt and a deadlock actuator. The latch bolt is actuated by manual means camming the latch bolt to a retracted position while a spring normally biases the latch bolt to an extended locking position. A dead bolt actuator maintains the latch bolt in the locked position when the deadlock actuator is in the retracted position.

The Fish U.S. Pat. No. 3,353,383 shows a combination lock and a key-operated lock for operating a latch. The latch mechanism is combined with the combination lock mechanism so as to assure automatic cancellation of the combination with closing of the door. An electrically operated system is associated with the latch and lock mechanism to provide safeguards which automatically operate to indicate or defeat unauthorized attempts to disable the system or to decode the combination lock mechanism. The operation of the door latch mechanism under control of the combination lock mechanism is entirely without dependence on the electrically operated system. The locking system does not provide alternative operation of the latch by the key and combination lock with the override of the key unlocking system as set forth in this invention.

The Fengler U.S. Pat. No. 3,115,765 shows a permutation lock. This lock provides for push buttons which selectively operate on groups of gears within a housing. This device provides only a permutation lock arrangement and does not provide for a lock per se for a door.

The Van Deudekom U.S. Pat. No. 3,747,377 shows a permutation door lock means. A permutation lock mechanism controls retraction of the door latch mens by the knob on the door. A mechanism is so connected between the door knob and the latch means and a control element on the permutation lock mechanism that rotation of the knob to effect retraction of the latch mechanism and door opening is permitted only after proper decoding of the permutation lock mechanism. The device is a permutation lock and a control for the latching of the door.

The applicant's invention provides for a combination lock system for a narrow stile door. The combination lock of the type shown in the Fish U.S. Pat. No. 3,353,383 or the Fengler U.S. Pat. No. 3,115,765, may be used. The combination lock together with a knob provides for manual opening of the door. A key unlocking system provides an alternate way of unlocking the door and also an override for a combination lock system. The key unlocking system can be selectively used for unlocking the door and there is no need for knowing the code of the combination lock.

The drive mechanism for the combination lock and the key locking system and selective and alternative operation of the applicant's invention, is distinguishable from that shown in the references.

It is an object of this invention to provide a combination lock and key for selectively and alternatively operating of the door latch and thereby providing two levels of security.

It is another object of this invention to provide a combination lock to avoid the need for the wide distribution of keys for employees who need to gain access to a restricted area; and a key unlocking system which overrides the combination lock system and can prevent use of the code unlocking at selected times, whereby the keys may be distributed to selected people who require access to the area. This prevents using code unlocking at particular times when the code chamber is locked out.

It is a further object of this invention to provide a combination lock and a key override for unlocking a latch with each independent of each other and to provide latch bolt hold-back with the latch in the retracted position if desired.

It is a further object of the invention to provide a combination lock and key operated latch independent of each other, with the key and knob operated latch hold-back if desired. The combination lock includes push buttons to receive the code for the combination lock, and a control knob to manually operate the latch bolt when the combination is applied to the lock.

It is a further object of this invention to provide a lock with a combination chamber control and key-operated control for selective operation of the lock. A key operated lock-out is provided to selectively lock-out operation of the lock by the combination chamber control and limit operation of the lock by key only.

It is a further object of this invention to provide a latch hold-back on a slide assembly operating a latch on a combination and key operated lock. A slide retainer hold the slide and latch in a retracted position and allows the key to be withdrawn from the lock.

The objects of this invention are accomplished in a combination lock with push buttoms on a panel for code input to the combination chamber. A reciprocal slide mechanism is used to operate a cam means to retract the latch bolt. A manual control connected to the combination chamber is permitted to operate the slide mechanism when the proper code is applied and the knob is turned. A key operating mechanism selectively and alternately operates the slide mechanism and cam means to retract a latch bolt. A means is provided for a combination change when so desired by the operator.

Referring now to the drawings, the preferred embodiment of the invention is illustrated.

FIG. 19 shows the interposer drive in a position clearing the cylinder cam as the slide is returned from the retracted position.

Figure 1:
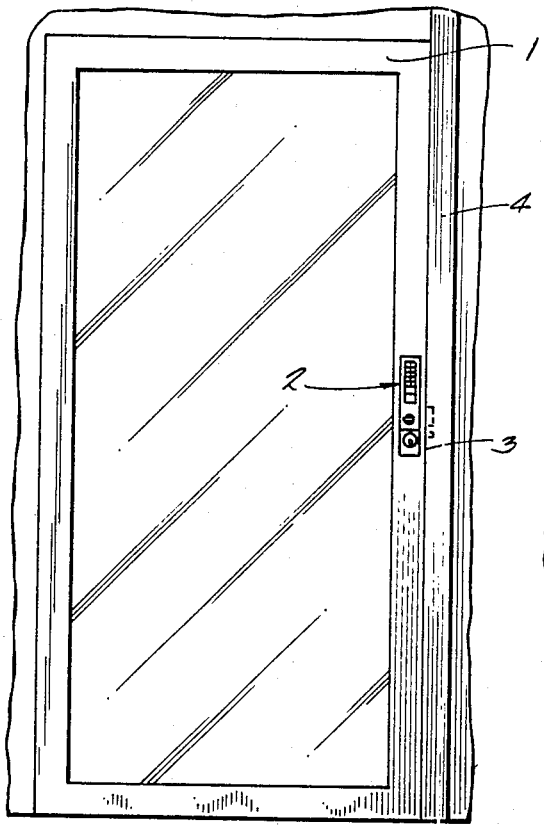
FIG. 1 illustrates a lock mounted on a door.

Referring to the drawings a door 1 is shown adapted for pivotally mounting on its left-hand side on hinges not shown. A combination lock and key-operated lock 2 is mounted on the right-hand side of the door 1 for engaging strike 3 on the doorjamb 4 on the right-hand side of the door 1.

Figure 2:
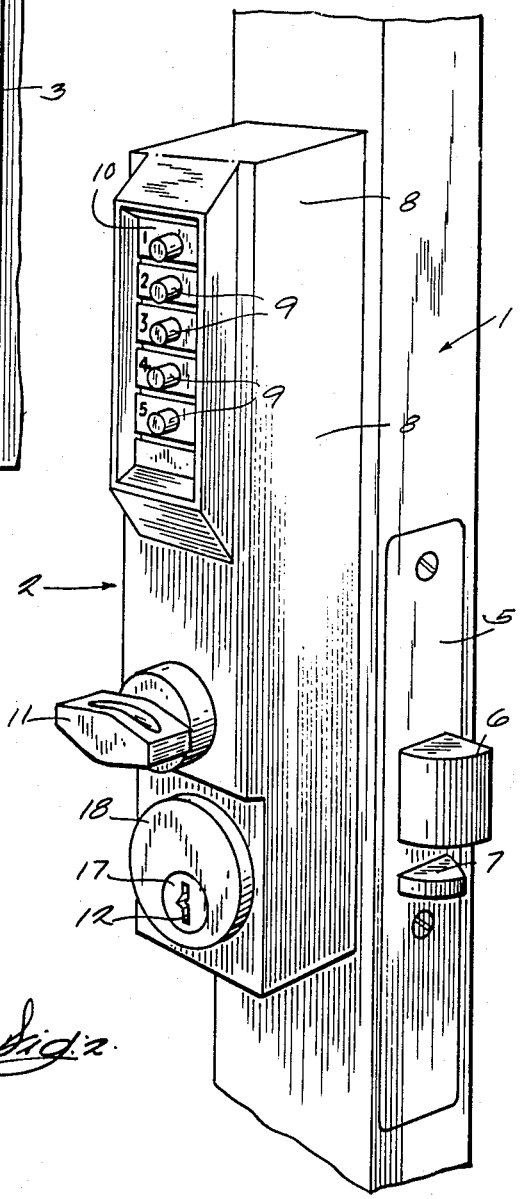
FIG. 2 illustrates a three dimensional view of the combination and key lock mounted on the side of a door with the latch bolt extending from the edge of the door.

FIG. 2 illustrates an enlarged view of the latch and operating means. The door 1 includes a plate 5 carrying the latch bolt 6 and the auxiliary latch bolt actuator 7. The lock control housing 8 encloses the combination lock control and the key lock control. The push buttons 9 are mounted on a panel 10 carried on the housing 8. The knob 11 operates a lever 36 within the lock control housing 8. The keyslot 12 is formed in the key cylinder 17 which is rotatable within the eccentric bushing 18.

Figure 3:
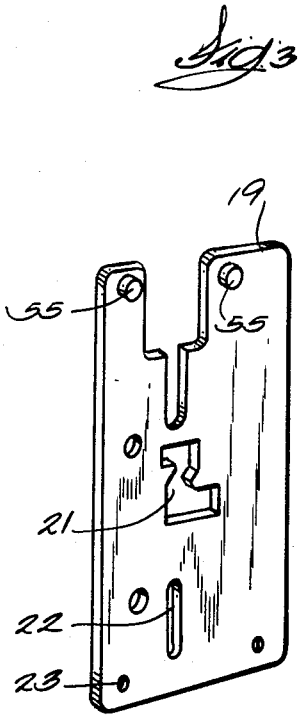
FIG. 3 is a three dimensional view of a slide which reciprocates to operate the latch.
Figure 4:
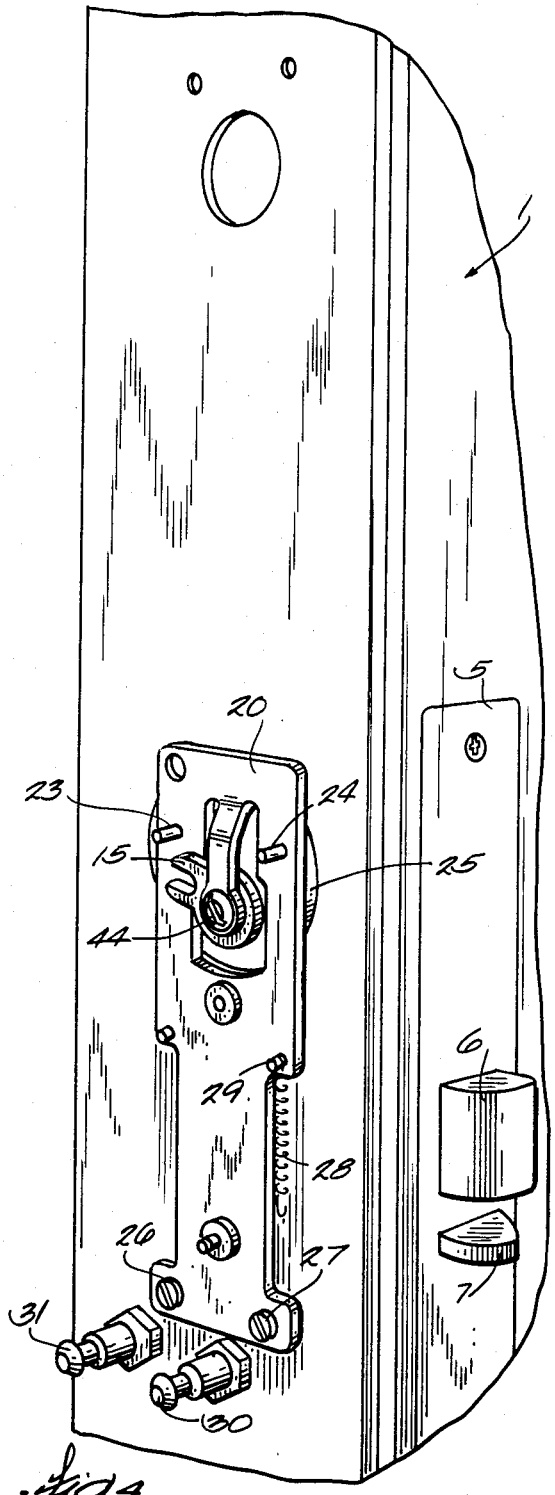
FIG. 4 is a three dimensional view of the door carrying the latch operating mechanism to which the slide normally is attached.
Figure 12:
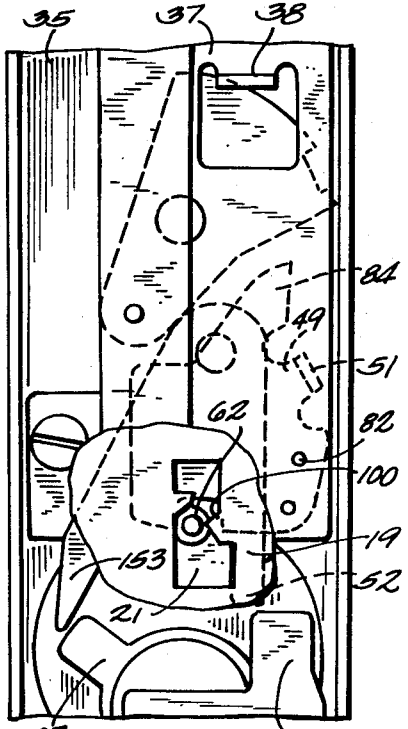
FIG. 12 is a view of the slide mechanism for operating the latch bolt which is carried on the side of the door panel.

A slide 19 shown in FIG. 3 is normally mounted on the plate 20 in a manner as shown in FIG. 12. The "Z" slot 21 is adapted for retaining the latch bolt in the holdback position as will be described subsequently. Slot 22 provides a guide maintaining the reciprocal movement of the slide 19.

The plate 20 has mounted thereon pins 23 and 24, plate 20 has its upper end fixed to cam plug 25 by screw 44. The opposite end of the plate 20 is fastened by means of the screws 26 and 27. A spring 28 is connected between the pin 29 on the frame 20 and the hole 231 on the slide 19 for biasing the slide to a retracted position. The studs 30 and 31 are fastened in the stile of the door for fastening the lock control housing 8.

Figure 5:
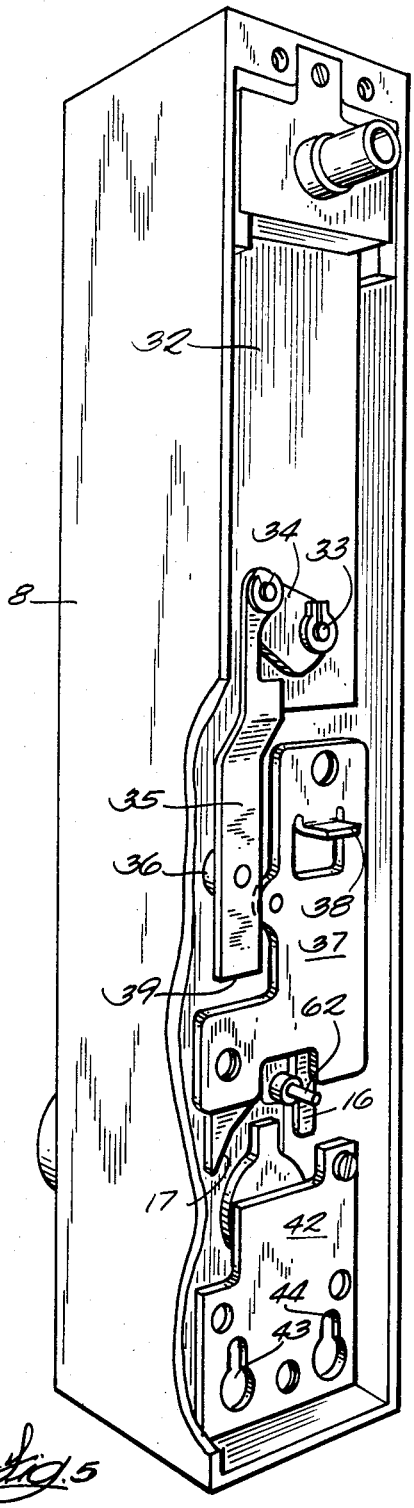
FIG. 5 is a three dimensional view of the housing carrying the combination lock and key lock, and showing the underside of the housing and mechanism which fits against the panel on the side of the door.
Figure 6:
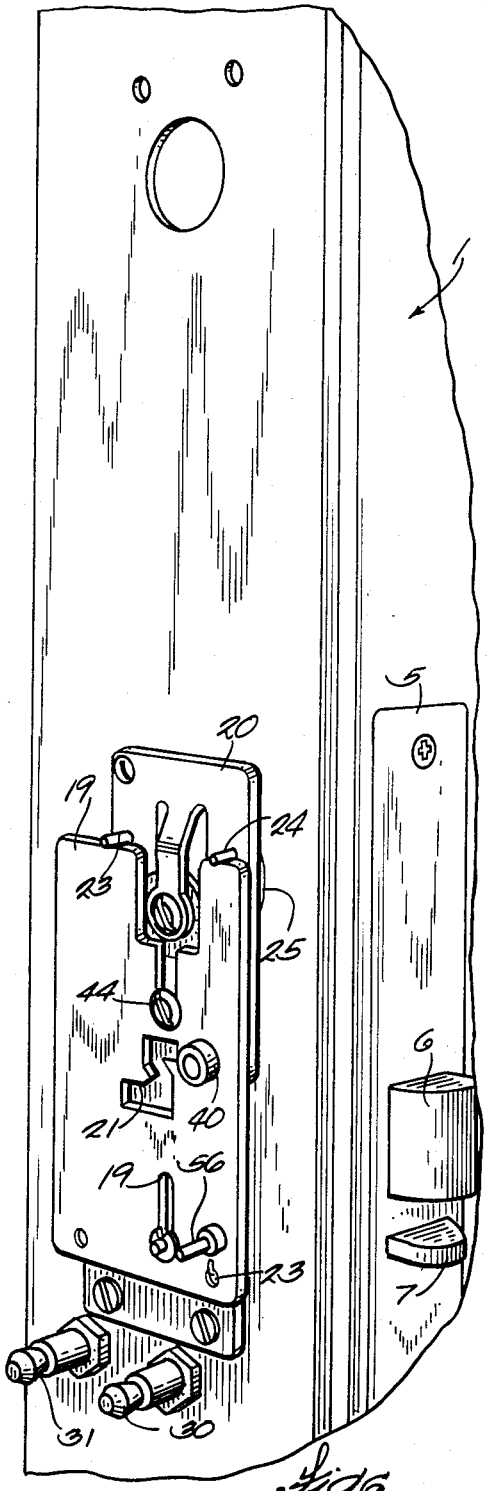
FIG. 6 illustrates a three dimensional view of the vertical stile on the door which carries the slide of the drive mechanism and is adapted for fitting within the underside of the housing shown in FIG. 5.

FIGS. 5 and 6 illustrate enlarged views of the lock housing 8 and the underside of the mechanism as well as the top side of the door panel and supporting structure for the slide assembly. These two assemblies which are shown ninety degrees to each other are normally put together in the assembled position. The combination lock assembly is fitted within the casing 32 which locks or allows rotation of shaft 33 and the lever 34. When the combination code is applied to the push buttons 9 it will release the shaft 33 to rotate on its axis. The lever 34 is connected with a link 35 to a lever 36 which is driven by a manual knob 11 carried on a clutch mounted within the lock housing.

The clutch bearing support 37 is fastened on the underside of the lock control housing 8 and is formed with a tab 38. The tab 38 is for vertical registration at lock to drive assembly against a pin 23 which also positions the plate 20 on the cam plug 25. A link 35 has an end portion 39 operating as a cam and engaging the cam roller 40 which in turn operates as a cam follower to reciprocate the slide 19. The slide 19 operating the yoke lever 15 and cam plug 31 which in turn operates the cam lever 53 and retracts the latch bolt 6.

The locking plate 42 is fastened to the bottom of the lock control housing 8 and is fitted with two elongated slots 43 and 44 for receiving the studs 31 and 30 in assembling of the lock control housing on the door.

Figure 7:
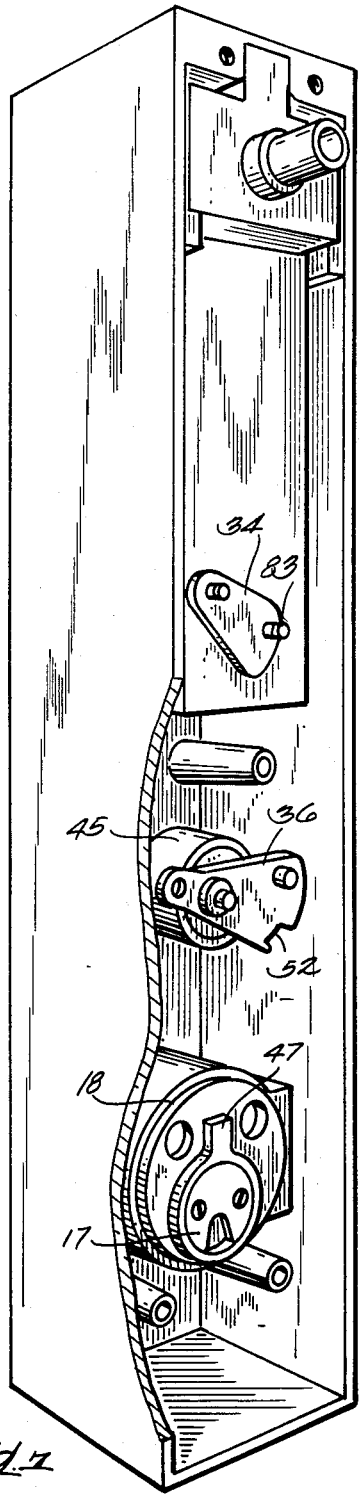
FIG. 7 shows a three dimensional view of the underside of the housing carrying the combination lock clutch and the key lock.
Figure 8:
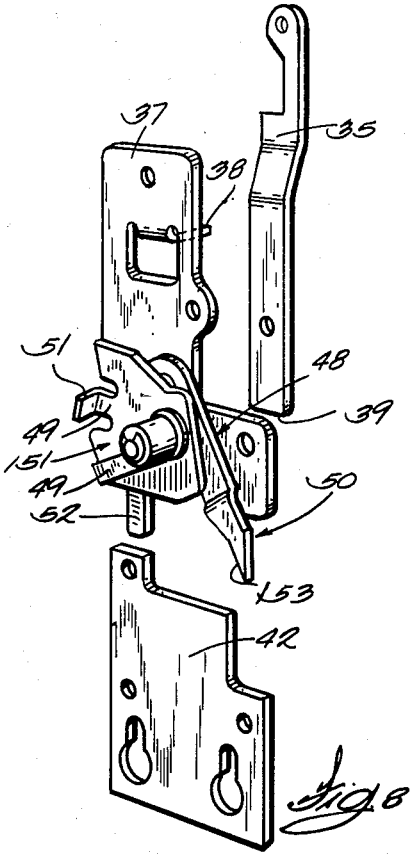
FIG. 8 illustrates the mechanism which normally is fitted to the underside of the housing for the combination lock and the key lock, and is swung out ninety degrees to show the underside of the mechanism.

FIGS. 7 and 8 show the mechanism in the lock control housing disassembled in subcombinations to more clearly show the components. The clutch 45 carries a lever 36 which is connected to the link 35 which, in turn, drives the lever 34.

The eccentric key bushing 18 is mounted within the lock control housing and carries the key cylinder 17, and cam 47 which engages the interposer mechanism 48. The interposer 49 is pivotally supported on the bearing support plate 37 as well as the interposer drive 50. Interposer drive 50 and interposer 49 are also connected through the stud 151. The cam 47 of the key cylinder 17 selectively engages the arm 52 and 153 of the interposer drive 50 in controlling the position for chamber lock-out or chamber unlocking position from the combination control assembly.

Figure 9:
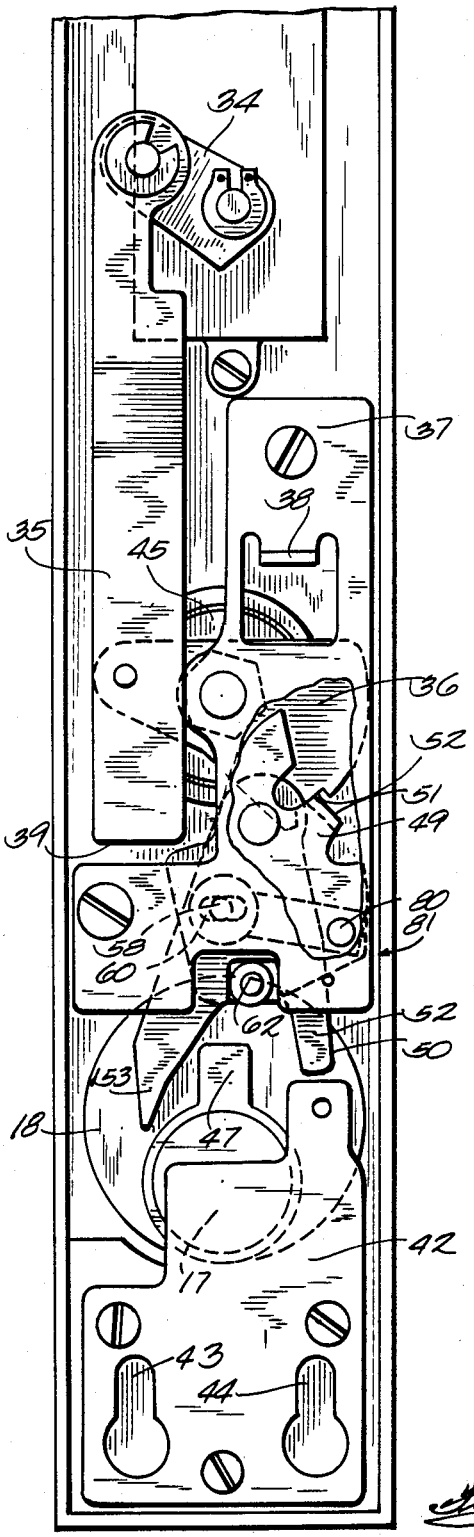
FIG. 9 is a view of the underside of the housing which encloses the combination lock and the key lock.
Figure 10:
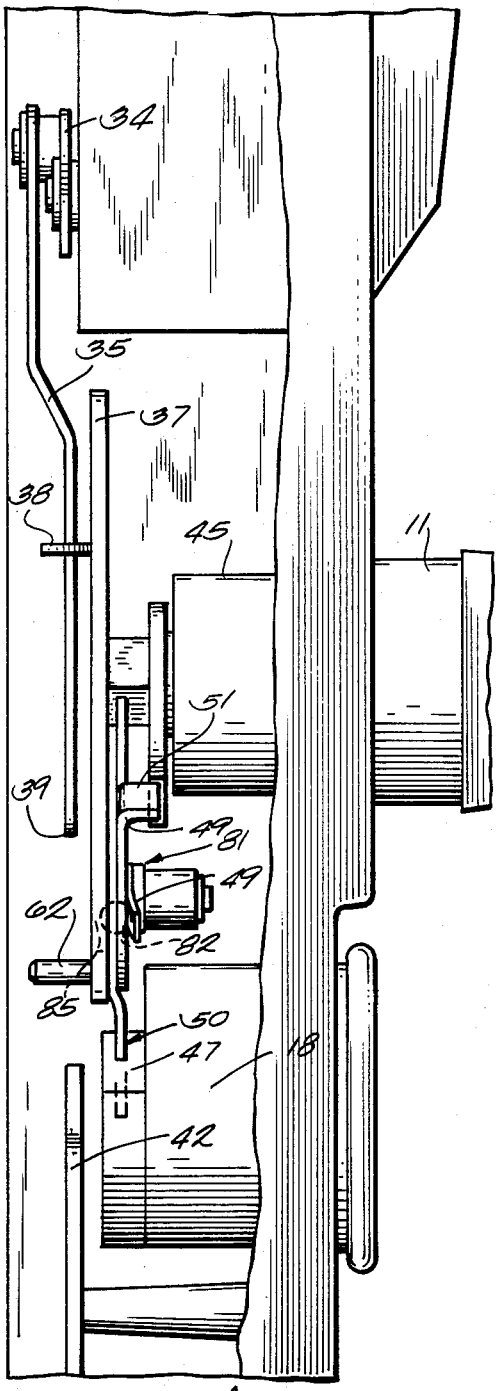
FIG. 10 is a partially sectioned side view of FIG. 9, showing the side of the mechanism in the housing for the combination lock and key lock.

FIGS. 9 and 10 show the combination lock system in the chamber lock-out position in which the knob 11 cannot be rotated. The interposer 49 has a flange 51 seated in the slot 52 of the lever 36 which is connected to the clutch 45 and manually operated knob 11. This positions the interposer 49 in a position in which the knob clutch assembly cannot rotate either way. It is noted that the arm 52 of the interposer drive 50 is moved to a right-hand position. This is normally done by the cam 47 on the key cylinder 17 in approximately 45° counterclockwise rotation.

FIGS. 9 and 10 show the lock control housing and the mechanism contained therein from the bottom side of the housing and also from the side of the housing showing the mechanism in the lock position.

Figure 11:
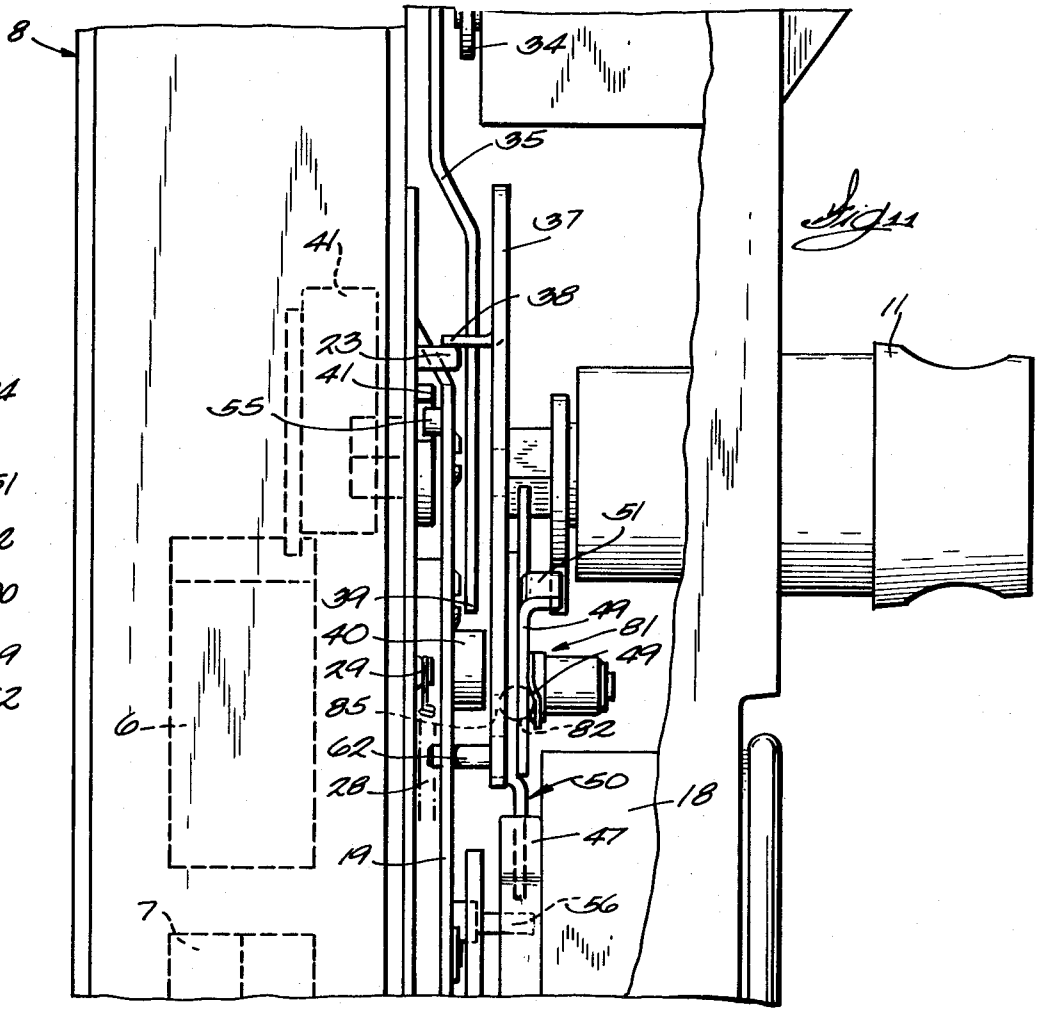
FIG. 11 is an enlarged side view of the mechanism shown in FIGS. 9 and 10.

FIG. 11 illustrates the lock control housing assembled with the door. A tab 38 of the clutch-bearing support 37 engages the pin 23 for vertical positioning and fastening the two assemblies together. The studs 30 and 31 are received within slots 44 and 43.

Figure 13:
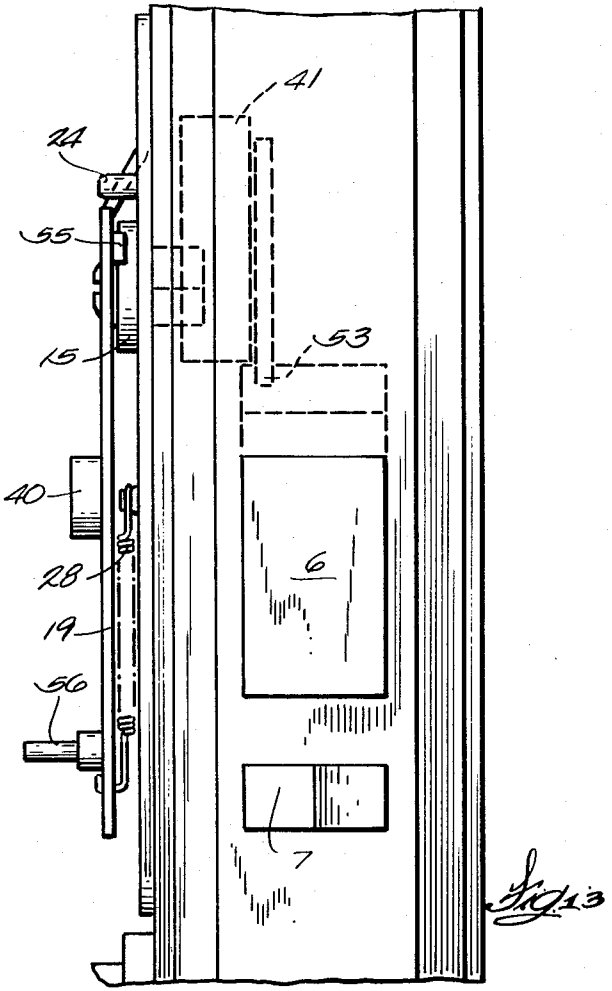
FIG. 13 is a side elevation view of the mechanism shown in FIG. 12.
Figure 12:
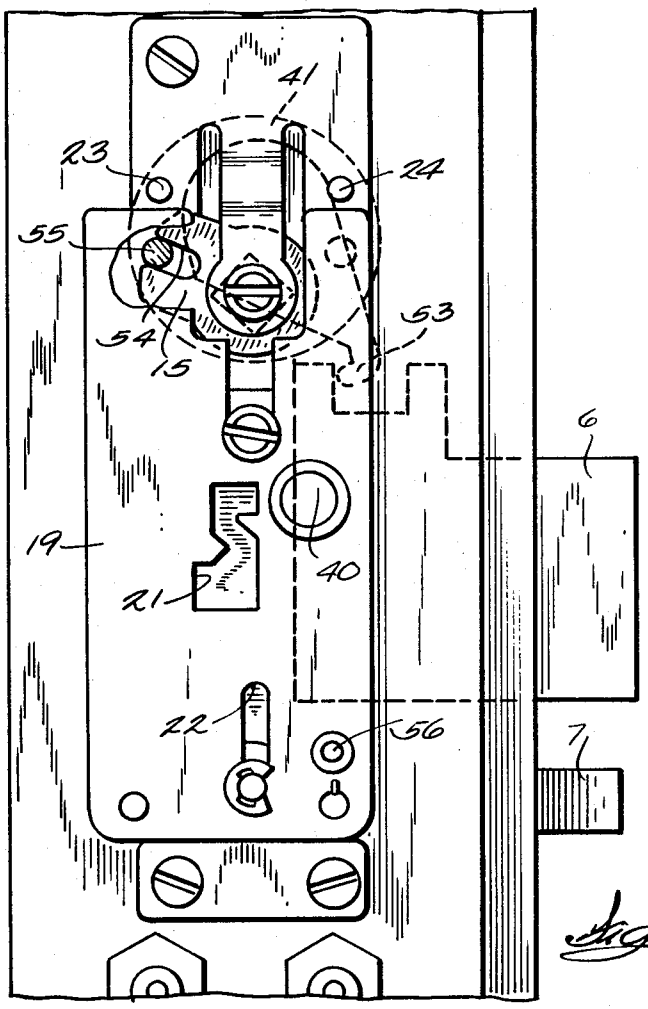

FIGS. 12 and 13 show primarily the operation of latch bolt 6 and 7. FIG. 12 shows the latch bolt 6 in the extended position and the cam 53 of the cam plug 41 engaging the latch bolt 6. The cam plug 41 is connected to the yoke lever 15 which defines a slot 54 which received a pin 55 on the slide 19. As the slide is reciprocated the cam 53 returns the latch 6 to a retracted position. The slide is normally biased to a retracted position by the spring 28. Normally the latch bolt 6 is biased to the extended position.

Figure 15:
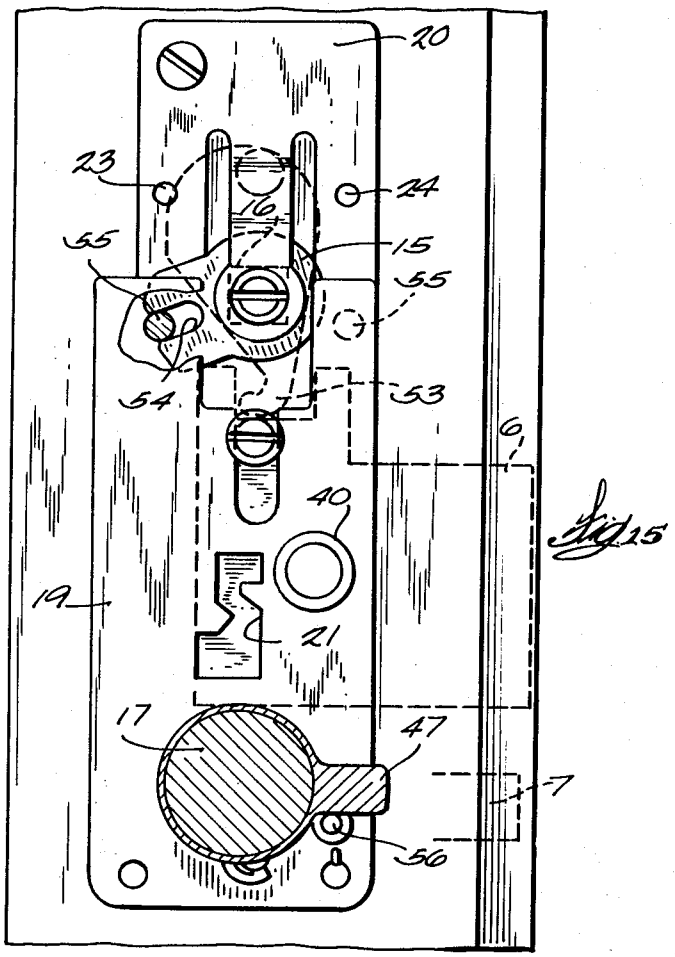
FIG. 15 is a similar view to that shown in FIG. 14, showing the latch operating mechanism with the latch bolt in a retracted position.
Figure 14:
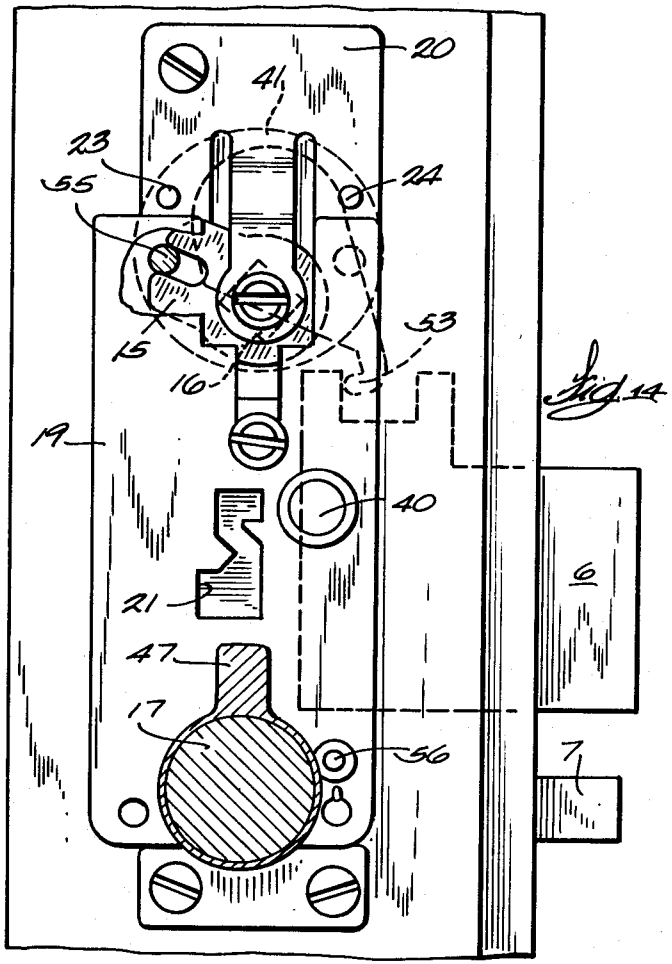
FIG. 14 is a view of the latch operating mechanism with the latch bolt in the extended position.

The latch bolt 6 can be retracted either through manipulation of the combination lock and subsequent turning the knob 11, or it can be actuated through the key cylinder. FIGS. 14 and 15 show the two means of actuating the latch bolt.

Referring to FIG. 14, as the slide 19 moves downwardly it rotates the yoke lever 15 in a counterclockwise direction. The pin 55 on the slide 19 is received in the slot 54 of the lever 15.

The cam plug 41 is provided with cams, not shown, whereby the cam 53 is caused to rotate in a clockwise direction while the lever 15 is rotating in a counterclockwise direction. In this manner, the latch bolt 6 is cause to move in a left-hand direction and retracted position, allowing the door to unlock. The force causing the downward movement of the slide 19 comes from the knob 11 which is rotated in a clockwise direction, as viewed in FIG. 3. Rotation of the knob causes the link 35 to move downward bearing against the cam follower 40 and reciprocating the slide 19.

FIG. 15 illustrates the retracted position of the slide 19. However, the movement of the slide is caused by the cam 47 on the key cylinder 17. This movement is caused when the key is inserted in the key slot 12, as shown in FIG. 2; and the key is rotated in a clockwise direction causing the cam 47 to bear against the pin 56. The pin 56 is carried on the slide 19. In this manner, the slide moves to a retracted position and the lever 15 moves in a counterclockwise direction as indicated in FIG. 15. This in turn causes the cam 53 to rotate in a clockwise direction, retracting the latch bolt 6 as shown in FIG. 15.

Figure 18:
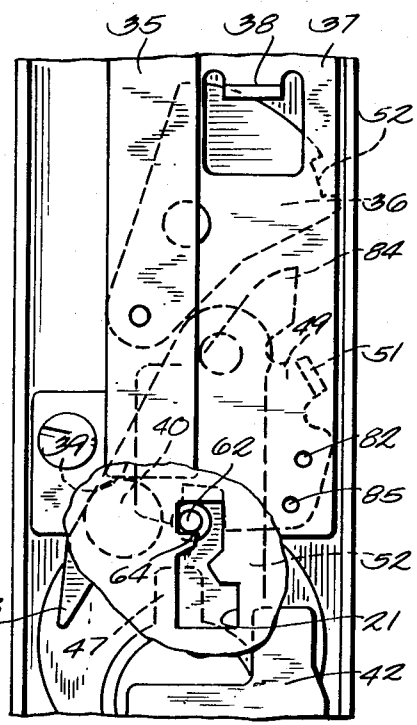
FIG. 18 shows the latch hold-back position for the slide mechanism with rotation of the key cylinder cam ninety degrees counterclockwise and rotation of the knob forty-five degrees clockwise with a latch hold-back pin in the "Z" slot retaining the latch in the hold-back position.
Figure 17:
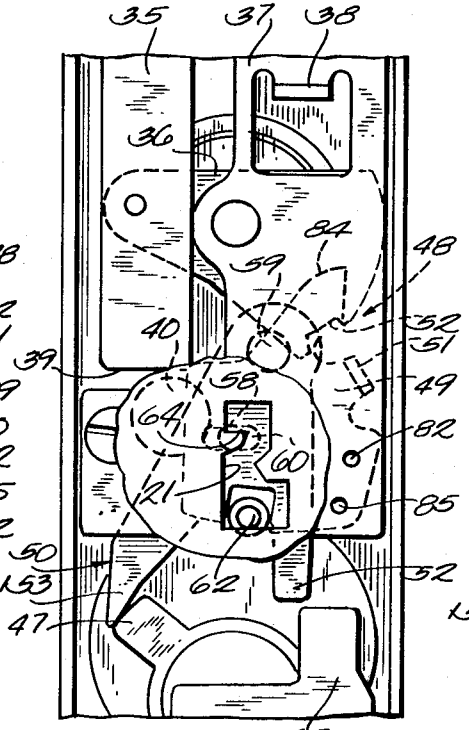
FIG. 17 is similar to FIG. 16 with the key cylinder cam rotated forty-five degrees from the neutral position and the interposer free from the lever and the combination lock.
Figure 16:
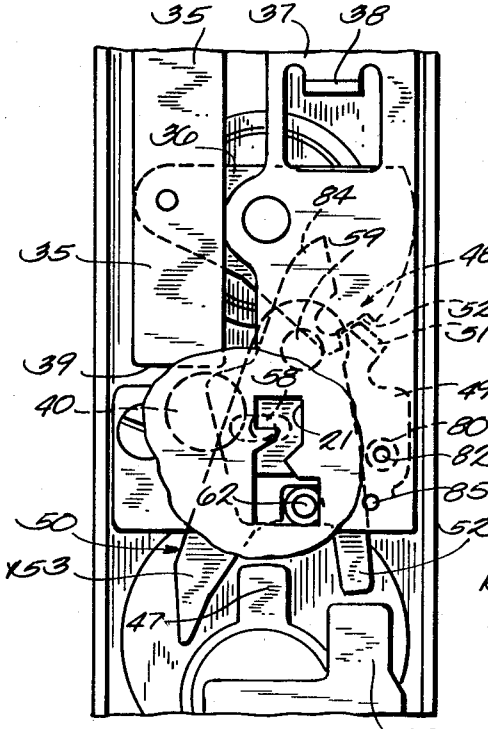
FIG. 16 illustrates the underside of the drive mechanism including the slide with the interposer in the chamber lockout position of the combination lock which prevents knob rotation.

FIGS. 16, 17 and 18 show various positions for the interposer mechanism for controlling the latch bolt position. As shown in FIGS. 9, 16 and 17, the interposer is pivotally mounted on the pin 58 in the clutch bearing support 37. The interposer drive 50 is pivotally mounted on the pin 59 which is also mounted in the clutch bearing support 37. Since there is relative pivotal movement between the interposer drive 50 and the interposer 49, the elongated slot 60 is provided in the arm 61 of the interposer drive.

FIG. 16 shows the mechanism in the lock control housing in the lockout position preventing unlocking of the latch bolt from the knob 11. In this position, the interposer drive 50 is pivoted to the right-hand position by the key cam 47. The key cam 47 is shown returned to the neutral position. In this position, the interposer 49 is pivoted so that the tang 51 is locked in the notch 52 so that the lever 36 cannot rotate. When the lever 36 is locked in this position, the knob 11 cannot rotate since it is connected to the lever 36. Thus it is impossible to unlock the door from the combination lock mechanism even though the combination lock mechanism were decoded.

FIG. 17 shows the interposer drive 50 pivoted in clockwise direction by the key cam 47. In this position the tang 51 is removed from the notch 52 so that unlocking of the bolt may be accomplished with the combination lock. By inserting the proper coding to the buttons in the combination lock, the knob 11 can now rotate and the lever 36 will pivot in the counterclockwise direction as viewed in FIG. 17 allowing retraction of the latch bolt.

FIG. 18 shows the hold-back position of the interposer mechanism when the latch bolt is held in the retracted position. In this position a pin 62 on the interposer is allowed to ride upwardly in the "Z" slot 21 and the latch bolt is retracted as the key cam 47 is rotated counterclockwise as viewed in FIG. 18. When the pin 62 is all the way up to the "Z" slot, as shown, the knob 11 is rotated in a clockwise direction to a stop position as viewed in FIG. 18 which shifts the pin 62 to a position on top of the edge 64 of the "Z" slot. This holds the slide 19 and retains the latch bolt in the retracted position.

The door locking system operates in the following manner. The lock control housing 8 encloses the combination lock and the key lock mechanisms and is mounted on the side of the door for operating the latch bolt 6 and auxiliary latch bolt 7. The code for the combination lock is preset as desired and access to the restricted area is accomplished by input of the preset code to the combination lock. When the proper code is applied to the combination lock, the knob 11 is free to rotate in a clockwise direction as viewed in FIG. 2. By rotating the knob in a clockwise direction, the link 35 is moved downwardly and caused to engage the cam follower 40 biasing the slide 19 downwardly. This, in turn, causes the pin 55 in slot 54 to move the yoke lever 15 in a counterclockwise directon. This in turn drives the cam 53 in a clockwise direction which engages the latch bolt 6, causing it to retract into the door and allow the door to be opened. When the knob 11 is released, it rotates to its original neutral position, automatically scrambling the combination lock, and in order to open the door again it is necessary to again apply the code to the combination lock.

If it should be desired to place the door in the unlocked or unlatched position, this can be accomplished by use of the key in the key slot 12 of the key cylinder 17. Rotation of the key and the key cylinder in the clockwise direction, as viewed in FIG. 2, will cause the cam 47 to engage the pin 56, reciprocating the slide 19 downwardly to the positon shown in FIG. 15. This, in turn, will cause the yoke lever 15 to rotate to the position shown in FIG. 15, and also causes the cam 53 to retract the latch bolt 6.

FIG. 17 shows cam 47 positioning interposer drive 50 during retraction of slide 19, as shown in FIG. 6. The influence of the cylinder cam with pin 56 will initiate positioning the interposer in a zero detent position. If left in this position a marginal condition would exist for restoring the key to the shed position. To facilitate key removal during the return motion of slide 19, the interposer pin 62 is moved to the raised portion of the "Z" surface on slide 19. This influences the interposer drive position inceasing the clearance between cam 47 and the interposer drive proper.

This results in a positive mechanical action and will eliminate movement of the interposer drive to a cylinder cam interference point, resulting from a shock or a vibrated condition.

The clockwise rotating cam 47 engages arm 153 of interposer drive 50 causing it to pivot. Interposer 49 also pivots counterclockwise with the interposer drive 50 causing detent ball 80 of detent 81 to lift from detent opening 82. Counterclockwise rotation of knob 11 and lever 36 causes pin 83 on lever 36 to engage arm 84 of interposer 49 causing the interposer to pivot further until ball 80 of detent 81 drops in opening 85. This moves pin 62 onto edge 64.

When the latch bolt 6 is in the retracted position and the pin 62 is in the upper end of the "Z" slot 21, as shown in FIG. 18, and the knob 11 is rotated counterclockwise and the pin 62 is seated on the edge 64, the latch is held in a retracted or latch hold-back position, and closing the door will not require the code to be applied to the combination lock in order to open the door. Returning the key to a vertical position or "key shed" position permits removal of the key, while the door is unlatched.

Release of the slide from its hold-back position allows pin 62 to move downwardly in "Z" slot 21. Edge 100 in the "Z" slot 62 biases the interposer drive 50 to a position clearing cylinder cam 47 and allowing key removal.

When it is desired to prevent entry into the restricted area by using the combination lock, the key is inserted in the key slot 12 and the cam 47 rotated about forty-five degrees in the clockwise direction, as viewed in FIG. 16. This will cause the tang 51 to seat in the notch 52 and lock the lever 35 from turning. With the lever 36 locked in position, the knob 11 cannot be rotated in either direction and the door can not be unlocked through the use of the code for the combination lock. In this position only a key will be able to unlock the door.

In order to release the lock so that it can be again unlocked through use of the code and the combination lock, the key is inserted in the slot and rotated to a counterclockwise direction about fifty-five degrees from the vertical position, as viewed in FIG. 17. In this position it releases the lever 36 allowing it to rotate after the code is applied to the combination lock.

The key will override any of these positions and will open the lock by inserting the key in the key slot and rotating it about ninety degrees to the right engaging pin 56, as shown in FIG. 15, to cause the latch bolt to retract and allow opening of the door.

The invention is defined by the following claims:

We claim:

1. A door locking means comprising:

a door;

a combination lock on said door;

a latch bolt on said door, means normally biasing said latch bolt to an extended latched position, a latch release for retracting the latch bolt against the biasing force to a retracted position; a mechanism including a member mounted on said door means normally biasing said member to a retracted position connected with said latch release, said mechanism including interposer means selectively and alternatively interrupting and transmitting control through the combination lock or key lock control;

a combination lock control;

a manual latch control operator connected to said combination lock control for selectively and alternatively operating said mechanism and said door latch release for unlatching said latch bolt; and a key operated lock control for selectively and alternatively operating said mechanism and said latch release to unlatch said latch bolt.

2. A door locking means as set forth in claim 1, including, retainer means engaging said mechanism operated by said key operated lock control to retain said latch bolt in the retracted position while permitting removal of said key from said key operated lock control.

3. A door locking means as set forth in claim 1, wherein said latch release defines a cam plug connected between said mechanism and said latch bolt to selectively transmit a force for retracting said latch bolt when said mechanism is operating.

4. A door locking means as set forth in claim 1, wherein said mechanism is a slide mechanism, an interposer mechanism connected to said manual control and said slide mechanism, a cam on said key operated lock control for selectively and alternatively engaging said interposer allowing said combination lock to operate said slide mechanism, and interrupting operation of said combination lock through said slide mechanism selectively and alternatively in response to operation of said key control.

5. A door locking means as set forth in claim 1, including an interposer mechanism, said interposer mechanism including an interposer drive, said key operated lock control including a cam for engaging said interposer drive to selectively and alternatively position said drive to move said interposer into one of two positions, said interposer selectively interrupting or transmitting the unlocking force from said manual latch control operator for opening of said latch bolt.

6. A door locking means as set forth in claim 1, wherein the mechanism is a slide mechanism, said slide mechanism is reciprocatively mounted on said door, said latch release defines a cam plug positioned in said door engaging said slide mechanism. and said cam plug selectively disengages said latch bolt in response to a force from said manual control.

7. A door locking means as set forth in claim 1, including a key operated lock-out for locking out operating of said latch bolt by said combination lock control.

8. A door locking means as set forth in claim 1, wherein said key operated lock control includes a key cylinder having a slot for receiving a key for rotating said key cylinder, said mechanism is a slide mechanism, a cam surface on said key cylinder for engaging said slide mechanism for reciprocating said slide mechanism and retracting said latch for opening said door.

9. A door locking means comprising:

a door;

a combination door locking control on said door;

a key operated door locking control on said door;

a latch bolt in said door normally biased to a extended latched position;

a manually operated door unlocking member;

a linkage connected between said manually operated door locking member and said combination locking control, said combination locking control preventing normal movement of said linkage when said combination lock is in the locked position;

a slide mechanism mounted on said door, means biasing said mechanism to a return position, interposer means selectively and alternatively directing operation of said slide mechanism by said linkage and combination locking control and said key control;

a latch release connected between said slide mechanism and said latch bolt to bias said latch bolt to a retracted position responsive to operation of said slide mechanism, said interposer means controlling operation of said slide mechanism selectively and alternatively responsive to decoding of said combination lock, and operation of said manually operated door unlocking member and operation of said key control responsive to a key.

10. A door locking means as set forth in claim 9, including a cam plug having a cam connected between said slide mechanism and said latch bolt for biasing said latch bolt to a retracted unlocked position responsive to movement of said slide.

11. A door locking means as set forth in claim 9, wherein said key operated door locking control comprises a bushing mounted on said door, and a key cylinder having a cam and forming a key slot in said bushing for rotation responsive to a key, with said cam reciprocating said slide mechanism.

12. A door locking means as set forth in claim 9, including means defining a "Z" slot in said slide mechanism, a pin on said interposer means received in said slot, said "Z" slot defining a slide hold-back surface and an interposer guide surface, said key operated door locking control including a key cylinder cam for selectively operating said slide mechanism, said pin selectively engaging said hold-back surface when said slide is in the hold-back position and biasing said interposer to inactivate said cylinder cam when said pin engages said interposer guide surface.

13. A door locking means as set forth in claim 9, wherein said linkage defines a driving cam surface, a cam follower on said slide mechanism for engaging said cam surface on said linkage for reciprocating said slide mechanism when said linkage is operated.

14. A door locking means as set forth in claim 9, comprising means defining a longitudinal slot having a transverse edge in said slide mechanism, said key operated door locking control including a cam biasing said slide mechanism to an extended position, an interposer mechanism pivotally mounted on the housing means, a pin on said interposer received in said slot, said manually operated door unlocking member biasing said pin to engage the transverse edge on said slot for holding said slide in the extended position and said latch bolt in the unlatched position.

15. A door locking means as set forth in claim 9, wherein said key operated door locking control includes a cam engaging said slide mechanism to bias said slide in the extended position and for unlocking said latch bolt, said combination door locking control including a cam surface on a link in said linkage and a cam follower on said slide mechanism, said link biasing said slide mechanism for retracting said latch bolt when said manually operated door unlocking member is operated.

16. A door locking means as set forth in claim 9, including a cam on said key operated door locking control, a pin on said slide mechanism, said cam biasing said pin on said slide mechanism to extend said slide mechanism and retract said latch bolt when said key operated door locking control is operated, said linkage including a link defining a cam surface, a cam follower on said slide mechanism, said cam surface engaging said cam follower for biasing said slide mechanism to an extended position and retracting said latch bolt when said manually operated door unlocking member is operated.

17. A door locking means comprising:

a door;

a spring biased latch bolt normally biased to an extended latched position;

a combination lock control connected to said latch bolt for selectively and alternatively retracting said latch bolt when said combination lock is decoded;

a key operated lock control connected to said latch bolt for selectively and alternatively retracting said latch bolt; interposer means selectively and alternatively directing operation of said latch bolt by said combination lock control and said key operated lock control, said key operated lock control including means for overriding operation and locking out operation by said combination lock control.

18. A door locking means as set forth in claim 17, including a manual control means, a slide mechanism mounted on said door, a reciprocal link connected between said combination lock control and said manual control means and reciprocating said slide, a slot in said slide having a transverse edge, a retainer means engaging said slide, said retainer means engaging said transverse edge to maintain a retracted position of said slide and said latch bolt when said slide is in the retracted position.

19. A door locking means as set forth in claim 17, including:

a rotating shaft in said combination lock control, a manual latch control means, a shaft connected to said manual control means, a lever on said manual control means connected through a link to said shaft in said combination lock control, said combination lock restricting rotation of said shaft in said combination lock unless said lock is decoded.

20. A door locking means as set forth in claim 17 including, an interposer between said combination lock control and said latch bolt for selectively and alternatively transmitting and interrupting an unlocking force from said combination lock control to said latch bolt, a cam means on said key operated latch bolt operator for selectively positioning said interposer for transmitting and interrupting said unlocking force.

* * * * *